US010199147B2

(12) United States Patent
Petruska et al.

(10) Patent No.: US 10,199,147 B2
(45) Date of Patent: Feb. 5, 2019

(54) OMNIDIRECTIONAL ELECTROMAGNET

(71) Applicant: University of Utah Research Foundation, Salt Lake City, UT (US)

(72) Inventors: Andrew J. Petruska, Salt Lake City, UT (US); Jacob J. Abbott, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 302 days.

(21) Appl. No.: 14/436,679

(22) PCT Filed: Oct. 18, 2013

(86) PCT No.: PCT/US2013/065678
§ 371 (c)(1),
(2) Date: Apr. 17, 2015

(87) PCT Pub. No.: WO2014/063048
PCT Pub. Date: Apr. 24, 2014

(65) Prior Publication Data

US 2015/0318101 A1 Nov. 5, 2015

Related U.S. Application Data

(60) Provisional application No. 61/715,625, filed on Oct. 18, 2012.

(51) Int. Cl.
*H01F 3/00* (2006.01)
*H01F 7/20* (2006.01)

(52) U.S. Cl.
CPC ..... *H01F 7/20* (2013.01); *H01F 7/206* (2013.01)

(58) Field of Classification Search
CPC ..... H01F 7/20; A61B 1/00016
(Continued)

(56) References Cited

U.S. PATENT DOCUMENTS 3,161,047 A 12/1964 Griswold
3,989,363 A 11/1976 McKay et al.
(Continued)

FOREIGN PATENT DOCUMENTS

CN 101072005 A 11/2007
GB 2248006 A 3/1992
WO WO 95/02807 A1 1/1995

OTHER PUBLICATIONS

Carta et al.; "A Wireless Power Supply System for Robotic Capsular Endoscopes"; Sensors and Actuators A: Physical; (Aug. 2010); pp. 177-183; vol. 162, Issue 2.
(Continued)

*Primary Examiner* — Alexander Talpalatski
(74) *Attorney, Agent, or Firm* — Thorpe North & Western, LLP

(57) ABSTRACT

An omnidirectional electromagnet (100) is disclosed. The omnidirectional electromagnet (100) comprises a ferromagnetic core (110) and three orthogonal solenoids (120, 130, 140) disposed about the core (110). Each solenoid (120, 130, 140) is adapted to receive a current from a current source to control an orientation and a magnitude of a magnetic field generated by the omnidirectional electromagnet (100). One or more omnidirectional electromagnets (100) can be used as a single magnetic manipulation system. The magnetic field generated by the omnidirectional electromagnet system can be used to control at least one of a force, a torque, an orientation, and a position of an adjacent magnetic object.

18 Claims, 5 Drawing Sheets

(58) Field of Classification Search
USPC ..... 335/297; 600/118
See application file for complete search history.

(56) References Cited

U.S. PATENT DOCUMENTS

| | | | | |
|---|---|---|---|---|
| 4,180,863 | A | 12/1979 | Joshi | |
| 5,032,792 | A | 7/1991 | Wing et al. | |
| 5,036,282 | A | 7/1991 | Morich et al. | |
| 5,699,048 | A | 12/1997 | Galloway | |
| 5,812,044 | A * | 9/1998 | Sakamoto | F16D 27/112 192/84.1 |
| 6,344,824 | B1 | 2/2002 | Takasugi et al. | |
| 6,720,930 | B2 | 4/2004 | Johnson et al. | |
| 6,995,729 | B2 | 2/2006 | Govari et al. | |
| 7,173,507 | B2 * | 2/2007 | Ries | A61B 1/00158 335/299 |
| 7,422,654 | B2 | 9/2008 | Lindley et al. | |
| 8,027,714 | B2 | 9/2011 | Shachar | |
| 8,029,436 | B2 * | 10/2011 | Shimizu | A61B 1/00016 600/101 |
| 8,235,888 | B2 * | 8/2012 | Kawano | A61B 1/0005 600/101 |
| 8,289,023 | B2 | 10/2012 | Kuzmin et al. | |
| 8,450,997 | B2 | 5/2013 | Silverman | |
| 8,475,363 | B2 * | 7/2013 | Reinschke | A61B 19/22 335/299 |
| 8,907,667 | B2 * | 12/2014 | Klein | G01R 33/04 324/244 |
| 9,095,261 | B2 * | 8/2015 | Kawano | A61B 1/0005 |
| 2005/0228259 | A1 * | 10/2005 | Glukhovsky | A61B 1/00029 600/407 |
| 2007/0270628 | A1 * | 11/2007 | Kawano | A61B 1/00158 600/12 |
| 2009/0227840 | A1 * | 9/2009 | Uchiyama | A61B 1/00158 600/118 |
| 2010/0305429 | A1 | 12/2010 | Shachar et al. | |
| 2011/0009697 | A1 * | 1/2011 | Kawano | A61B 1/00158 600/117 |
| 2011/0263951 | A1 * | 10/2011 | Chiba | A61B 1/041 600/302 |
| 2012/0023969 | A1 * | 2/2012 | Subramaniam | F25B 21/00 62/3.1 |
| 2012/0105180 | A1 | 5/2012 | Molteni | |
| 2012/0126800 | A1 | 5/2012 | Vernickel et al. | |
| 2012/0126808 | A1 | 5/2012 | Knopp et al. | |
| 2012/0139375 | A1 | 6/2012 | Masuzawa et al. | |
| 2012/0232337 | A1 * | 9/2012 | Juloski | A61B 19/22 600/102 |
| 2013/0182829 | A1 | 7/2013 | Nguyen et al. | |
| 2014/0333143 | A1 * | 11/2014 | Kim | H01F 38/14 307/104 |

OTHER PUBLICATIONS

Kummer et al.; "OctoMag: An Electromagnetic System for 5-DOF Wireless Micromanipulation"; In: International Conference on Robotics and Automation; (May 8, 2010); pp. 1610-1616; IEEE.

Petruska et al.; "An Omnidirectional Electromagnet for Remote Manipulation"; In: 2013 IEEE International Conference on Robotics and Automation (ICRA); (May 6-10, 2013); pp. 814-819.

International Preliminary Report on Patentability dated Apr. 21, 2015, in International Application No. PCT/US2013/065678, filed Oct. 18, 2013; 6 pages.

* cited by examiner

| Solenoid | Length $[L/L_s]$ | Width $[W/L_s]$ | Thickness $[T/L_s]$ | $\beta_1$ | $\beta_2$ |
|---|---|---|---|---|---|
| Inner | 0.77 | 0.57 | 0.10 | 0.74 | 1 |
| Middle | 0.90 | 0.77 | 0.07 | 0.85 | 1 |
| Outer | 1 | 0.90 | 0.05 | 0.90 | 1 |

| Solenoid | Length $[L/L_s]$ | Width $[W/L_s]$ | Thickness $[T/L_s]$ | $\beta_1$ | $\beta_2$ |
|---|---|---|---|---|---|
| Inner | 0.74 | 0.63 | 0.09 | 0.86 | 1.11 |
| Middle | 0.89 | 0.82 | 0.06 | 0.92 | 1.07 |
| Outer | 1 | 0.95 | 0.05 | 0.95 | 1.05 |

OMNIDIRECTIONAL ELECTROMAGNET

RELATED APPLICATION

This application claims the benefit of U.S. Provisional Application No. 61/715,625, filed Oct. 18, 2012, which is incorporated herein by reference.

GOVERNMENT INTEREST

This invention was made with government support under 0654414 and IIS0952718 awarded by the National Science Foundation. The government has certain rights in the invention.

FIELD OF THE INVENTION

The present invention relates generally to magnetic systems which are spatially manipulable. Therefore, the invention involves the fields of magnetism, physics, and magnetic manipulation.

BACKGROUND

Magnetic microscale and mesoscale devices, such as capsule endoscopes and microrobots, can be manipulated with an externally generated magnetic field. The magnetic field applies a combination of force and torque to the device without a mechanical connection. Magnetic manipulation systems have been used to drag a device along a path, roll a device across a surface, or point a device in a desired direction, such as magnetic catheters and magnetotactic bacteria.

Magnetic manipulation systems have incorporated permanent magnets and electromagnets. Although the dipole moment magnitude of a typical electromagnet can vary through a change in electrical current, the dipole moment orientation of such an electromagnet can be cumbersome to move dynamically. On the other hand, the dipole moment orientation of a permanent magnet is typically easier to move dynamically, but its dipole moment magnitude is fixed.

A combination of permanent magnets and electromagnets can be used to produce a suitable magnetic field for a manipulation task. Some tasks, however, tend to be better suited to either permanent magnet or electromagnet systems. For example, because electromagnet systems have more direct control of field strength, they have been used for multi-degree-of-freedom levitation and positioning control. Permanent magnets, which require no electrical power to generate a field, are well-suited for pulling or rolling tasks that require the magnetic source to move along complex trajectories.

SUMMARY

Thus, it is desirable to combine the advantages of both traditional electromagnets and permanent magnets to generate and vary a dipole-moment magnitude and an orientation of a magnetic field, without moving parts. Accordingly, an omnidirectional electromagnet is provided. Such a magnet can comprise a ferromagnetic core and three orthogonal solenoids disposed about the core. Each solenoid can be adapted to receive a current from a current source to control an orientation and a magnitude of a magnetic field generated by the omnidirectional electromagnet. Because both attractive and lateral forces can be generated between a rotating dipole source and a sympathetically rotating magnetic device, a rotating dipole field can be more effective than the rotating uniform field generated by many electromagnet systems.

Figure 1A:
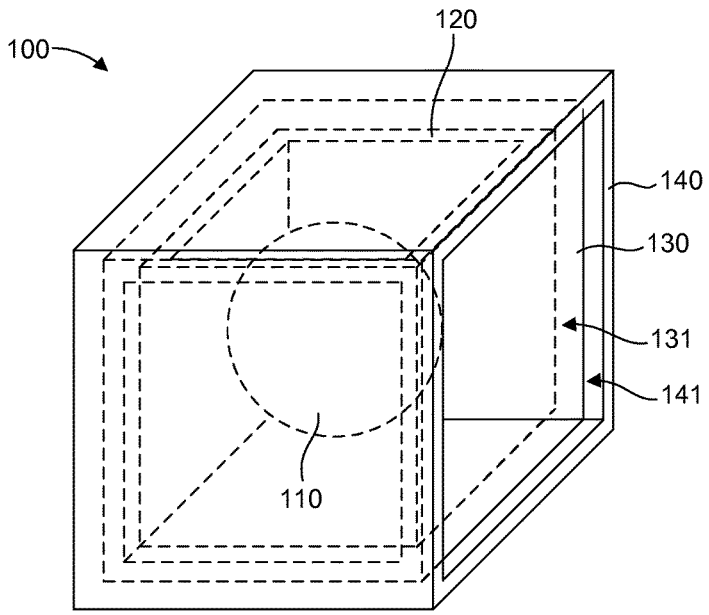
FIG. 1A is a perspective view of an omnidirectional electromagnet, in accordance with an example of the present disclosure.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Reference will now be made to certain examples, and specific language will be used herein to describe the same. Examples discussed herein set forth an omnidirectional electromagnet and system that can generate a field with a dipole-moment magnitude and orientation, which can both be varied without any moving parts, that can be used for object manipulation.

With the general embodiments set forth above, it is noted that when describing an omnidirectional electromagnet, or the related method, each of these descriptions are considered applicable to the other, whether or not they are explicitly discussed in the context of that embodiment. For example, in discussing the omnidirectional electromagnet per se, the system and/or method embodiments are also included in such discussions, and vice versa.

It is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "an omnidirectional electromagnet" includes one or more of such magnets and reference to "a solenoid" includes one or more of such solenoids.

Also, it is noted that various modifications and combinations can be derived from the present disclosure and illustrations, and as such, the following figures should not be considered limiting.

In describing and claiming the present invention, the following terminology will be used in accordance with the definitions set forth below.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Figure 1B:
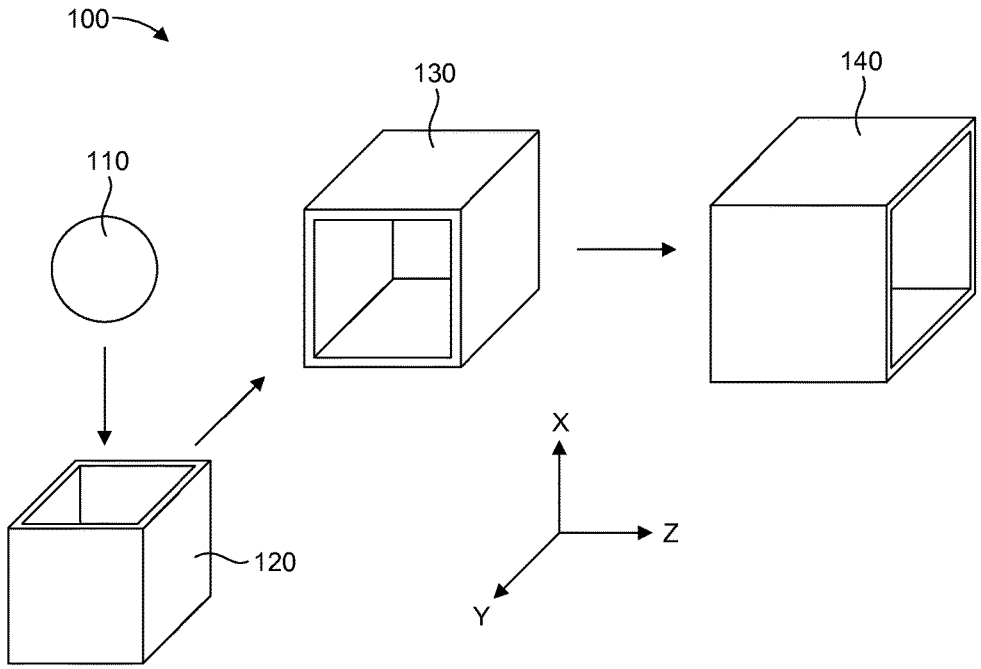
FIG. 1B is an exploded view of the omnidirectional electromagnet of FIG. 1A.
Figure 2A:
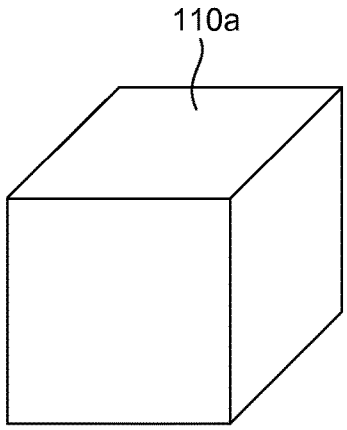
FIG. 2A illustrates a cubic ferromagnetic core, in accordance with one example of the present disclosure.
Figure 2B:
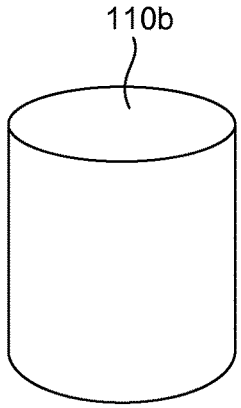
FIG. 2B illustrates a cylinder ferromagnetic core, in accordance with another example of the present disclosure.

Depicted in FIGS. 1A and 1B are conceptual illustrations of an omnidirectional electromagnet 100. As disclosed herein, the omnidirectional electromagnet can combine the control of field strength associated with traditional electromagnets and the control of dipole orientation associated with rotating permanent magnets, but without any moving parts, and can be formed by any set of collocated electromagnets that have dipole moments spanning $R^3$, the Euclidian space of real numbers in three dimensions. In accordance with one example of the present disclosure, the omnidirectional electromagnet can comprise a ferromagnetic core 110. Non-limiting examples of ferromagnetic materials can include iron, nickel, cobalt, alloys thereof (e.g. with other metals or metalloids), composites thereof, and the like. In one aspect, the core can be configured as a spheroid, such as a sphere as shown in FIGS. 1A and 1B. Other shapes can also be used for the core such as, but not limited to, a cube, cuboid, cylinder, and the like, as illustrated by cores 110*a*, 110*b* in FIGS. 2A and 2B, respectively. In another aspect, the core can comprise a substantially solid ferromagnetic material or shell of ferromagnetic material. Thus in one aspect, the core can be homogeneous throughout, while in an optional case the ferromagnetic material can form a shell around a second material. The second material can be another ferromagnetic material or can be any other non-ferromagnetic material.

A spherical core has at least three desirable properties. First, a sphere does not have a preferential magnetization direction, which lends itself to omnidirectionality. Second, when placed in a uniform field (similar to the field in the center of a solenoid), a sphere produces a point dipole field, which is well modeled analytically. Third, the average applied magnetic field within a sphere is equal to the magnetic field at the center of the sphere, making its average magnetization relatively simple to calculate. Configuring the omnidirectional electromagnet to include a spherical core can facilitate extending the field calculation to multiple omnidirectional electromagnets acting in concert. As such, finite element calculations would not be needed in order to facilitate real time (or near real time) control. It should be recognized that other core geometries with no preferential magnetization direction could be used (e.g., a cube or a cuboid), however, modeling the magnetic field may not be as accurately simplified as can be achieved with a spherical core. Accurate modeling of other such shapes may also result in more complicated calculations during operation.

With further reference to FIGS. 1A and 1B, the omnidirectional electromagnet 100 can further comprise three orthogonal solenoids 120, 130, 140 disposed about the core 110. Each solenoid can be adapted to receive a current from a current source to control an orientation and a magnitude of a magnetic field generated by the omnidirectional electromagnet. The shapes of these solenoids can be tailored for specific desired properties. In one design example, the solenoids can have the same dipole moment in every direction when the solenoids are each driven with the same current density. Alternatively, the solenoids can generate the same dipole moment in every direction when each solenoid is driven at its maximum current density, where the maximum current density is a function of factors such as heat dissipation. In another alternative, the solenoids can generate the same dipole moment rate of change in every direction when each solenoid is driven with the same applied voltage. In one aspect, at least one of the three orthogonal solenoids can be configured as a cuboid sleeve (e.g. a four-sided cuboid having two opposite open ends). In a particular aspect, all three orthogonal solenoids can be configured as cuboid sleeves, as illustrated in FIGS. 1A and 1B. In this case, a first solenoid 120 of the three orthogonal solenoids can be nested within a second solenoid 130 of the three orthogonal solenoids, which can in turn be nested within a third solenoid 140 of the three orthogonal solenoids. Thus, the solenoids can be characterized as having a generally square shell cross-section. This configuration is discussed in more detail below, specifically in conjunction with the spherical ferromagnetic core 110. In other aspects, the solenoids can be configured as other polygonal sleeves or cylindrical sleeves or can be configured to conform to the surface contour of the core. The solenoids can be fabricated by winding on a mold or frame to achieve the desire shape. Alternatively, the solenoids can be fabricated by winding directly on the ferromagnetic core. Other options for fabrication can be used as long as each solenoid is electrically insulated from the other solenoids.

In one aspect, a space, indicated at 131, 141, can be provided between adjacent solenoids 120, 130 and 130, 140, respectively, so that a coolant, such as a fluid, can be disposed between the adjacent solenoids. For example, the omnidirectional electromagnet 100 can include a coolant path configured to allow circulation of a coolant about one or more of the solenoids and the core, such as between adjacent solenoids. Thus, for example, the coolant path can include the space 131 and/or 141. Heat generated in each coil by ohmic heating can be offset by heat dissipation to the environment for sustained omnidirectional electromagnet use. Efficient cooling, therefore, can enable higher field strengths by increasing the maximum current the electromagnet can be subjected to continuously. This increased strength due to higher sustained currents can offset the reduction of strength owed to slightly smaller solenoids for cooling paths. In one embodiment, the omnidirectional electromagnet can be immersed in coolant. In another embodiment, an omnidirectional electromagnet can include a coolant inlet and a coolant outlet port. In one aspect, the inlet and outlet can be valved to control fluid flow into and out of the omnidirectional electromagnet. Suitable coolant fluids can include, but are in no way limited to, de-ionized water or aqueous solutions, heat transfer oils (e.g. THERMINOL, DOWTHERM, UCON, glycols, mineral oils, silicon oils, and the like). Such coolant fluids can generally also be non-conductive.

Figure 3:
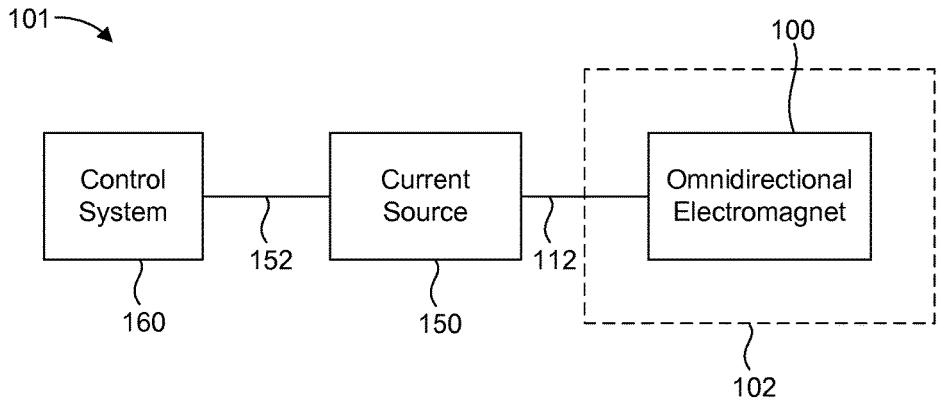
FIG. 3 is a schematic illustration of an omnidirectional magnet system, in accordance with an example of the present disclosure.

With reference to FIG. 3, and further reference to FIGS. 1A and 1B, an omnidirectional magnet system 101 is shown in accordance with the present disclosure. The system 101 can include an omnidirectional magnet as disclosed herein, such as the omnidirectional magnet 100. The omnidirectional magnet can be associated with an object 102, as described in more detail hereinafter, such that the omnidirectional magnet can be used to control a position and/or an orientation of the object or a force and/or a torque on the object. The omnidirectional magnet system 101 can also include a current source 150 electrically coupled 112 to the omnidirectional magnet, such as via one or more wires or cables. Each of the orthogonal solenoids of the omnidirectional magnet can be adapted to receive a current from the current source to control an orientation and a magnitude of a magnetic field generated by the omnidirectional electromagnet. To facilitate proper operation of the orthogonal solenoids, the solenoid and/or solenoid wires can be coated, embedded, or otherwise disposed within a resin or varnish. The resin can act to provide electrical insulation, thermal conduction, and/or to structurally bind the solenoid together such that no additional supporting structure is required to maintain shape of the solenoid.

In addition, the omnidirectional magnet system 101 can include a control system 160 operably coupled 152 to the current source 150 for controlling current to the omnidirectional electromagnet 100. The control system can control the current supplied by the current source to coordinate orientation and magnitude of the magnetic fields of the omnidirectional electromagnet to control a position and/or an orientation of the object 102 or a force and/or a torque on the object. In one aspect, the purpose of the omnidirectional electromagnet is to generate a magnetic field adjacent to the omnidirectional electromagnet. In a particular aspect, the purpose of the omnidirectional electromagnet is to apply force or torque to an adjacent magnetic device, such as the object 102, using the magnetic field generated by the omnidirectional electromagnet. In some embodiments, to accomplish the purpose and objectives of the omnidirectional electromagnet, the control system can include a microprocessor to execute a program designed to control the omnidirectional magnet.

Figure 4:
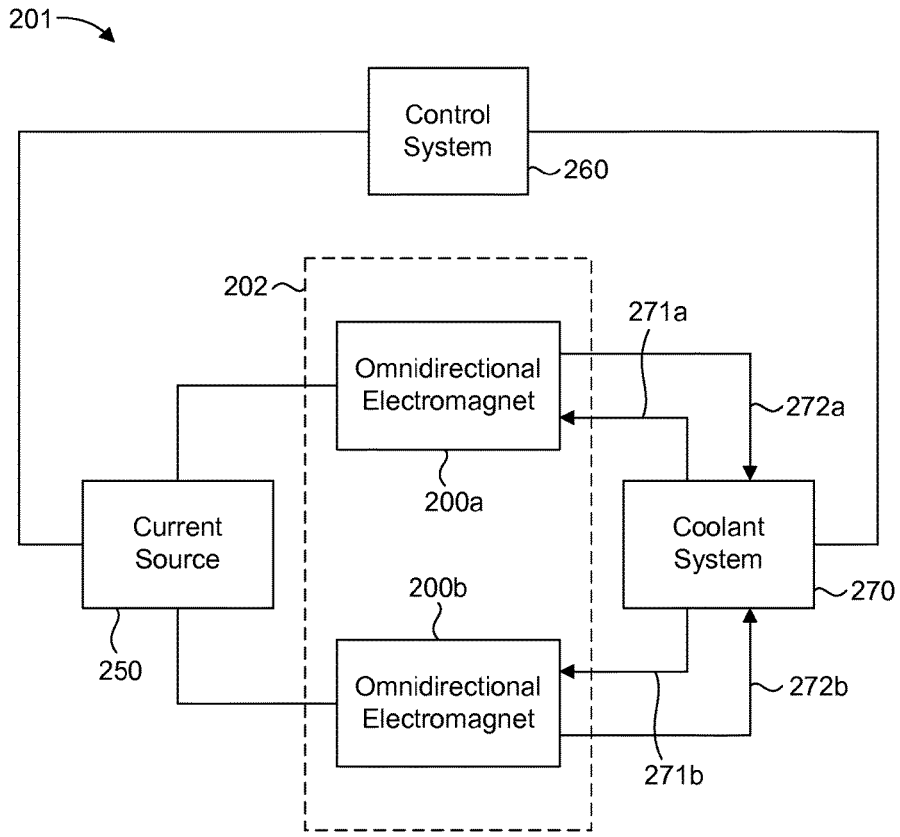
FIG. 4 is a schematic illustration of an omnidirectional magnet system, in accordance with another example of the present disclosure.

With reference to FIG. 4, another example of an omnidirectional magnet system 201 in accordance with the present disclosure is illustrated. The system 201 is similar to the system 101 of FIG. 3 in many respects. For example, the system 201 can include a current source 250 and a control system 260. The system 201, however, includes multiple omnidirectional magnets 200*a*, 200*b*, as disclosed herein, associated with an object 202, such that the omnidirectional magnets can be used together to control a position and/or an orientation of the object or a force and/or a torque on the object. In this case, currents provided by the current source to the orthogonal solenoids of the omnidirectional magnets can be configured to control an orientation and a magnitude of a magnetic field generated by the omnidirectional electromagnets. It should be recognized that any suitable number of omnidirectional magnets can be utilized. It should also be recognized that the current source can comprise any number of current sources electrically coupled to the solenoids.

In addition, the omnidirectional magnet system 201 can include a coolant system 270 operably coupled to the omnidirectional magnets 200*a*, 200*b*, such as by delivery lines 271*a*, 271*b* and return lines 272*a*, 272*b*, respectively. The coolant system can serve to circulate coolant through the omnidirectional magnets. For example, the coolant system can include a pump to cause the coolant to circulate through the omnidirectional electromagnets. In one aspect, the pump can be continuously operated to provide a constant flow of fluid through the omnidirectional electromagnets. In another aspect, operation of the pump can be controlled by a thermostat or timer to provide coolant flow upon reaching a predetermined temperature or time interval. In one embodiment, the control system can be configured to control operation of the coolant system, such as operation of the pump. Pumping parameters, such as volumetric flow rate, can also be controlled. In one aspect, the control system can also control coolant flow into and out of the omnidirectional electromagnet via control of an inlet and/or an outlet valve.

The control system can be any hardware, firmware or other computing device capable of controlling current source, and optionally coolant flow as outlined herein. Non-limiting examples of suitable control systems can include a standard desktop or laptop computer, handheld computing device, dedicated computing device, or the like. The control system can receive a desired device or controlled object position, orientation, force, and/or torque. Sensors can be used to obtain such information. The control system can then adjust voltage or current to the electromagnet to achieve a desired motion. Alternatively, the control system can monitor or estimate the electromagnet temperature to adjust cooling paths to allow for higher operating currents. In another aspect, the control system can modify the electromagnet position to further affect position, orientation, force, and/or torque on the controlled object.

Although the design and optimization of an omnidirectional electromagnet with square cross-section solenoids is discussed hereinafter, the methods can be extended to any number and shape of solenoids used to construct a generalized omnidirectional electromagnet.

Figure 5:
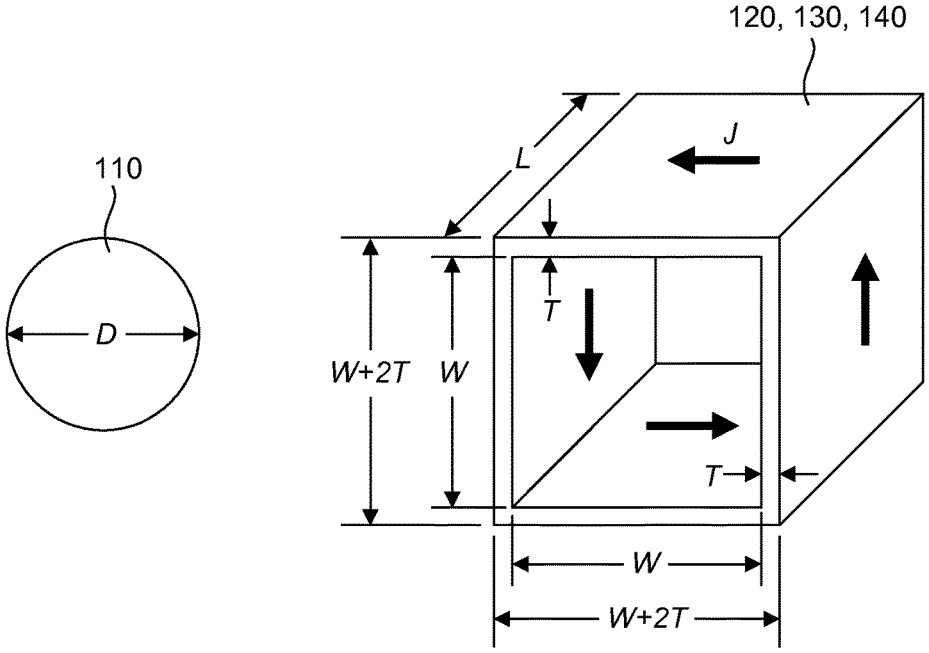
FIG. 5 identifies generic dimensions for a ferromagnetic core and orthogonal solenoids of the omnidirectional magnet of FIGS. 1A and 1B.

With reference to FIG. 5, which identifies generic dimensions for the ferromagnetic core 110 and the solenoids 120, 130, 140, and further reference to FIGS. 1A and 1B, the omnidirectional electromagnet 100 generates a magnetic field that can be approximated by a point-dipole field for positions outside of the omnidirectional electromagnet's minimum-bounding sphere. The point dipole field can be expressed in a coordinate-free form as $$B(p) = \frac{\mu_0}{4\pi\|p\|^3}(3\hat{p}\hat{p}^T - I)m \tag{1}$$

where p is the vector (with associated unit vector $\hat{p}$) from the center of the omnidirectional electromagnet to the point of interest, I is a 3×3 identity matrix, $\mu_0$ is the permeability of free space, and m is the dipole moment of the system, which is a linear combination of the dipole moments from each solenoid and the magnetized core.

The dipole moment for each square-cross-section solenoid is given by the vector area of the current density in the solenoid:

$$m = \frac{JL^4}{6}(\beta_2^3 - \beta_1^3)\hat{l} \tag{2}$$

where J is the current density in units $A \cdot m^{-2}$, L is the axial length of the solenoid (with associated axial unit vector $\hat{l}$), and $\beta_1$=W/L and $\beta_2$=(W+2T), respectively, describe the inner-width-to-length and outer-width-to- length aspect ratios. The maximum dipole moment a rectangular prism with a bounding cube of edge length L containing no ferromagnetic material can generate in one direction is given by (2) with $\beta_1$=0 and $\beta_2$=1, and is $$\frac{JL^4}{6}.$$

The maximum dipole moment that could be expected for any omnidirectional electromagnet with no ferrous material and edge length L is thus ⅓ of the unidirectional case:

$$\frac{JL^4}{18}.$$

The dipole moment of a low-coercivity and high-permeability ($\chi$>>1) spherical core, when magnetized in its linear region, is $$m_c = \overline{M}V = \frac{4\pi}{3\mu_0}R_c^3\left(\frac{\chi}{1+\frac{1}{3}\chi}\right)\overline{B} \approx \frac{4\pi R_c^3}{\mu_0}B_c \tag{3}$$

where the overbar represents a quantity averaged over volume V, $R_c$ is the radius of the core or D/2, and $B_c$ is the applied magnetic field at the center of the core, which is a linear combination of the field due to each solenoid, and can be calculated by the Biot-Savart law (for a square-cross-section solenoid with uniform current density) to be:

$$B_c = \frac{2L\mu_0}{\pi}\int_{\beta_1}^{\beta_2} \operatorname{atan}\left(\frac{1}{\sqrt{1+2\varsigma^2}}\,d\varsigma\right)\hat{l} \tag{4}$$

By combining the dipole moments due to the magnetized core and each of the solenoids, the total dipole moment of the Omnimagnet $m=m_x+m_y+m_z$ is thus:

$$m = \sum_{i\in\{x,y,z\}} J_i\left(\frac{L_i^4}{6}(\beta_{i,2}^3 - \beta_{i,1}^3) + 8L_iR_c^3\int_{\beta_{i,1}}^{\beta_{i,2}} \operatorname{atan}\left(\frac{1}{\sqrt{1+2\varsigma^2}}\,d\varsigma\right)\right)\hat{l} \tag{5}$$

where the indices x, y, and z correspond to the solenoid wound about the Cartesian x, y, and z axes, respectively. Without loss of generality, the inner most solenoid 120 can correspond to the x axis, the middle solenoid 130 can correspond to the y axis, and the outer solenoid 140 can correspond to the z axis, as shown in FIG. 1B.

One design choice for an omnidirectional electromagnet can require that $m_x=m_y=m_z$ when $J_x=J_y=J_z$, which provides only two of the ten constraints necessary to describe an omnidirectional electromagnet design. The additional eight degrees of freedom allow further tailoring of the design. For example, minimizing the free space (i.e., the space that is neither current-carrying nor ferromagnetic) and optimizing the core size will maximize the dipole-moment strength for an overall size and current density, whereas choosing to minimize the higher-order spherical harmonics associated with the solenoids would provide a more accurate dipole-field approximation. As a general guideline, if each of the three current densities are driven to their respective maximums, then the three magnetizations should be equal. This would be an optimized omnidirectional electromagnet as used herein. As such, current densities are not necessarily always equal, and the respective "maximum" being specified based on a certain set of design assumptions and subjective specifications set for a particular application. For example, the maximum current density that can be applied to a given solenoid could be established such that a steady-state temperature in the coil does not exceed some specified value (e.g., the value at which the wire's insulation would break down); this value could be different for each solenoid (e.g., the outermost solenoid may lose heat faster than the innermost solenoid due to its exposure to the outside air).

To minimize the free space, the width of the innermost solenoid 120 can be set equal to the diameter of the core 110 ($W_x=2R_c$), the length of each solenoid can be set equal to the width of the next (more outer) solenoid ($L_x=W_y$, $L_y=W_z$), and the profile of each solenoid can be a cube ($\beta_{x,2}=\beta_{y,2}=\beta_{z,2}=1$). Together, the six geometric constraints, the two definition constraints, the overall omnidirectional electromagnet size constraint on $L_z$, and the maximum-dipole-moment constraint, fully define the ten-parameter design space.

Minimizing the quadrupole term in the multipole expansion for the magnetic field produced by the solenoids yields an omnidirectional electromagnet that has minimum error with respect to the dipole-field model.

The quadrupole term can be calculated by a harmonic expansion of the vector potential of the field and has a magnitude that is proportional to a polynomial that is a function of the coil geometry. The polynomial for the quadrupole term of a solenoid of square-cross-section inner width W, length L, and winding thickness T is:

$$(15W^2-15L^2+40T^2+30TW)(4T^2+6TW+3W^2)-16T^4 \quad (6)$$

Geometries that set (6) equal to zero have no quadrupole term in the multipole expansion. The design constraints here are the same as with the maximum-strength design constraints except the requirement that each solenoid is a cube is replaced by the requirement that the geometry corresponds to a zero in the polynomial (6).

The following procedure can be used to find the geometry that satisfies all of the constraints, numerically. First, the overall size constraint is incorporated by nondimensionalizing the problem by normalizing all of the lengths by $L_z$ and the dipole moment by $$\frac{JL_{max}^4}{18}$$

(the no-ferromagnetic-material maximum dipole moment introduced above). Then, for a sequence of core diameters, the thicknesses of two solenoids can be adjusted to minimize the variance of $\{m_x; m_y; m_z\}$ given the design choice that $J_x=J_y=J_z$, while satisfying the geometric constraints. Equations 2, 4, 5 and 6 can be modified for non-cube solenoids by accounting for variations in x, y and z dimensions, while Equation 3 can be modified for non-spherical cores. Alternatively, finite element analysis tools can be used to estimate these variables for various shaped solenoids and/or cores without deriving corresponding equations explicitly.

Figure 6:
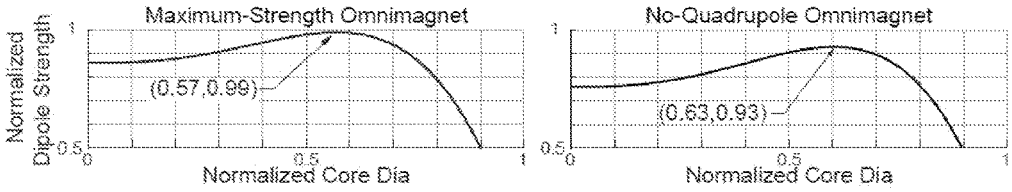
FIG. 6 is a table presenting results of a normalized optimization for an omnidirectional electromagnet, in accordance with an example of the present disclosure.

The results of the normalized optimization are shown in FIG. 6. Each point on the line shown in FIG. 6 corresponds to an omnidirectional electromagnet. In one aspect, a diameter of the ferromagnetic core can be between about 40% and about 75% of a maximum outer length of the third solenoid. In a specific aspect, a diameter of the ferromagnetic core can be between about 55% and about 60% of a maximum outer length of the third solenoid. This can be particularly suited to maximize the dipole-moment strength. The optimal design that maximizes strength has a core-diameter-to-outer-length ratio of 0.57 when each solenoid is configured as a cubic sleeve, where a given solenoid has equal length outer dimensions. In another specific aspect, a diameter of the ferromagnetic core can be between about 60% and about 65% of a maximum outer length of the third solenoid. This can be particularly suited to minimize or reduce error of the dipole field model while still maximizing the dipole moment produced. The optimal design that minimizes or reduces error of the dipole field model has an optimal core-diameter-to-outer-length ratio of 0.63. Other solenoid configurations can have varying optimal diameters but can be calculated using the principles outlined herein. It should be recognized that the outer dimensions of a cuboid sleeve can be sized to form a substantially perfect cube, or the outer dimensions can vary from one another by up to about 15%. Furthermore, one or both ends of a cuboid sleeve can be open ended to provide for nesting of the cuboid sleeves and or disposing a ferromagnetic core within a cuboid sleeve. It should be recognized that the aspect ratios of the nested cuboid sleeves can vary from one another.

The performance of the configurations presented in FIG. 6 may not be sensitive to small variations and may only marginally affect the performance. This can be beneficial because slight deviations from the optimal configuration, for example, can allow for conductor and/or coolant paths to the inner solenoids and/or to provide tolerances for assembly.

In the optimal maximum-strength design, the magnetization of the spherical core is able to compensate for the free-space inherent in the nesting and provides a 15% increase in dipole moment strength from an omnidirectional electromagnet with no core. Interestingly, this optimal configuration has a dipole moment in each direction that is 99% of the maximum that could be expected if all of the volume were being used to create the moments with no free space and no ferromagnetic material, but with less power consumption and more heat transfer surface area. Although the magnitude of the dipole moment in each direction is the same, the percentage of the dipole moment attributed to the core or the windings are different for each solenoid. For example, the percentage of the dipole moment from the (core/windings) is approximately (38/62), (24/76), and (18/82) for the inner, middle, and outer solenoids, respectively. The optimal no-quadrupole design is similar with (core/winding) percentages of approximately (41/59), (28/72), and (21/79). The error associated with a dipole-field model is reduced, but the reduction in coil volume to minimize the quadrupole term reduces the maximum moment to 93% of the maximum that could be expected if there were no free space and no ferromagnetic material. Interestingly, the geometry with no quadrupole term corresponds to coils that are wider than they are long. This coil geometry is advantageous because it makes realizing a design more feasible as open paths to the innermost solenoid for conductors are inherent in the geometry.

Since each solenoid in the omnidirectional electromagnet has a different geometry, the magnetic field produced by each solenoid will not have exactly the same shape for positions close to the omnidirectional electromagnet. To understand the subtle differences in field shape, multiple FEA simulations of both omnidirectional-electromagnet geometries were performed using Ansoft Maxwell 14.0. In these simulations, only one of the solenoids was energized at a time.

Figure 7:
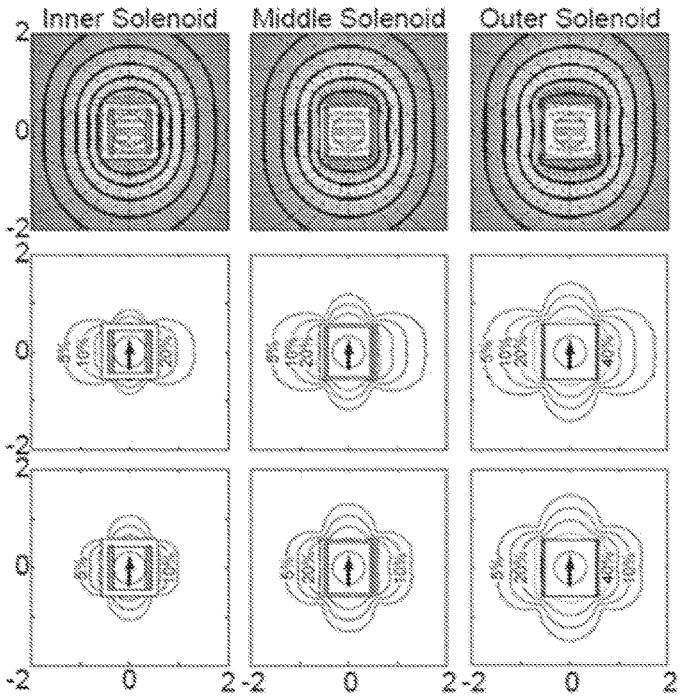
FIG. 7 illustrates results of simulations for field strength, field shape, and percent error from a point-dipole approximation for each solenoid of an omnidirectional electromagnet, in accordance with an example of the present disclosure.

The results of the simulations (field strength, field shape, and percent error from the point-dipole approximation) for each solenoid are shown in FIG. 7. As the outermost solenoid is the largest, it is responsible for the majority of the field deviations close to the omnidirectional electromagnet. The field in each direction rapidly reduces to a pure dipole field with distance. For example, the magnetic field shapes produced by the optimized designs reduce to within five percent of a point-dipole field within two minimum-bounding sphere radii. As illustrated, the no-quadrupole geometry has a tighter and more symmetric error band. Deviations from the point-dipole model are comparable to what would be seen with a non-spherical permanent magnet.

Other optimal solutions can be obtained if some of the constraining factors are relaxed while still satisfying the intent of an omnidirectional electromagnet. For example, using a cubic core can provide an approximately 48% increase in the amount of ferromagnetic material over a spherical core of the same width and can produce a stronger magnet for a given external dimension at the expense of a likely poorer fit to the dipole field model. With a spherical core, changing the shape of the solenoids from having a square cross-section of uniform thickness to a circular cross-section with both a radius and thickness that varies along the axis of the windings could eliminate all higher-order spherical harmonics and have a truly dipole field.

Other winding techniques, such as simultaneously winding the three orthogonal solenoids such that the orthogonal solenoids are intertwined with one another to create an overall weave around the core, can result in a more compact omnidirectional electromagnet with little or no free space. Conversely, optimizing the shape of the free space for convective or conductive heat removal can allow a higher current density to be used, creating a more compact magnet for an overall dipole moment. In all, there are many ways to define and realize an "optimal" omnidirectional electromagnet, optimized to specific design specifications. In each case, the optimized result can still produce a dipole-like field in any direction. Further, the dipole moment and resulting magnetic field for one or more of the solenoids can be completely turned off at any given instant. Materials can be chosen to exhibit low remanance (i.e. magnetic memory) such that remnant fields can be negligible with respect to responses of mechanical systems which are being controlled with the omnidirectional systems described herein.

In one aspect, the control system can be configured to model the magnetic fields in real time by using a precomputed field map for each omnidirectional electromagnet (e.g. FIG. 7) and by incorporating the field contribution at the center of each omnidirectional-electromagnet core due to the field of all other omnidirectional electromagnets in the system, resulting in a set of coupled algebraic equations. In one aspect, the precomputed field map described above can be replaced with dipole-field approximation of Equation (1) for faster and noise-free numerical computations, with a sacrifice in accuracy.

Thus, an omnidirectional electromagnet and system have been generally disclosed herein, as well as optimized designs for the specific instance of a generally square shell cross-section omnidirectional electromagnet for both the maximization of strength and the minimization of error between the omnidirectional electromagnet's field and that of a pure dipole field by eliminating the quadrupole moment. Because the omnidirectional electromagnet is capable of creating a dipole field oriented in any direction with a variable magnitude, it combines the advantages of both a rotating permanent magnet and a traditional electromagnet for the manipulation of magnetic devices.

The omnidirectional electromagnet can be particularly useful in a wide variety of applications. For example, the omnidirectional electromagnet can be configured for use in controlling or manipulating an object as described hereinabove, such as an in vivo medical device (e.g. a capsule endoscope, magnetically tipped catheter, MEMS for eye surgery or exploration, cochlear implant, urinary or reproductive surgical device, dexterous manipulator, endoscopic camera, swimming and crawling microscale and mesoscale device, magnetic screw, etc.). In one aspect, an object or device controlled or manipulated by an omnidirectional magnet can include a magnetic component for the application of one or both of a force and torque. In a particular example, an omnidirectional magnet can be used to maneuver a magnetically controlled capsule endoscope, such as in a gastrointestinal tract of a patient. In this case, the capsule can be swallowed and observed in the esophagus, stomach, intestines, and/or colon utilizing a gastroscope. The maneuverability of the omnidirectional magnet can be used to enhance diagnostic endoscopy as well as enable therapeutic capsule endoscopy. In another particular example, an omnidirectional magnet can be used to provide locomotion for a microrobot in soft tissue. In this case, the omnidirectional magnet can be attached to a screw to generate torque to rotate the screw and cause propulsion of the microrobot. Similarly, an omnidirectional magnet can be used to rotate a rigid helix to produce propulsion in a fluid. In addition, an omnidirectional magnet can be used along with a typical magnetic control system to control or manipulate an object. For example, an omnidirectional magnet can be used as a high-bandwidth "fine-control" system and a typical permanent-magnet or electromagnet manipulation system can be used as a low-bandwidth "rough-control" system to control or manipulate an object. Additional non-limiting examples of applications can include manipulation of a device within the brain or spine, for medical procedures on a developing fetus, a microscale device under the guidance of an optical microscope, a device in outer-space (e.g., deployed in or near a space station or satellite), and a device within a pipe or pipe-like structure.

The omnidirectional electromagnet can also be configured as a modular system that is readily attachable and replaceable from existing equipment. Multiple omnidirectional electromagnets can be configured for a specific medical procedure based on the anatomy of the patient and the procedure to be conducted, and the same omnidirectional electromagnets can be reconfigured for a new patient and procedure with minimal effort. The optimal number of omnidirectional electromagnets for a given procedure should not be assumed to be the same as the optimal number for a different procedure. Additionally, the size and strength of the individual omnidirectional electromagnets should not be assumed to be the same within a given procedure.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. An omnidirectional electromagnet, comprising:

a ferromagnetic core which is configured as a spheroid; and three orthogonal solenoids disposed about the core, each solenoid adapted to receive a current from a current source to control an orientation and a magnitude of a magnetic field generated by the omnidirectional electromagnet, wherein a variance between dipole moments of each solenoid is minimized when current density of each solenoid is equal, and such that a diameter of the ferromagnetic core is between 40% and 75% of a maximum outer length of an outermost solenoid of the three orthogonal solenoids.

2. The omnidirectional electromagnet of claim 1, wherein the ferromagnetic core comprises a solid core.

3. The omnidirectional electromagnet of claim 1, wherein the solenoids are disposed within a resin or varnish.

4. The omnidirectional electromagnet of claim 1, wherein at least one of the three orthogonal solenoids is configured as a cuboid sleeve.

5. The omnidirectional electromagnet of claim 4, wherein the three orthogonal solenoids are configured as cuboid sleeves, and a first of the three orthogonal solenoids is nested within a second of the three orthogonal solenoids, which is nested within a third of the three orthogonal solenoids.

6. The omnidirectional electromagnet of claim 1, wherein at least two of the three orthogonal solenoids are intertwined with one another.

7. The omnidirectional electromagnet of claim 1, further comprising a coolant disposed between at least two of the three orthogonal solenoids.

8. An omnidirectional electromagnet system, comprising:

a current source; and an omnidirectional electromagnet electrically coupled to the current source, and having a ferromagnetic core which is configured as a spheroid, and three orthogonal solenoids disposed about the core, each solenoid adapted to receive a current from the current source to control an orientation and a magnitude of a magnetic field generated by and adjacent to the omnidirectional electromagnet, wherein a variance between dipole moments of each solenoid is minimized when current density of each solenoid is equal, and such that a diameter of the ferromagnetic core is between 40% and 75% of a maximum outer length of an outermost solenoid of the three orthogonal solenoids.

9. The omnidirectional electromagnet system of claim 8, further comprising a control system for controlling current to the omnidirectional electromagnet to coordinate orientation and magnitude of the magnetic field of the omnidirectional electromagnet to control at least one of a position and an orientation of an object, or to control at least one of a force and a torque applied to an object.

10. The omnidirectional electromagnet system of claim 8, further comprising one or more additional omnidirectional electromagnets electrically coupled to the current source.

11. The omnidirectional electromagnet system of claim 10, further comprising a control system for controlling current to the omnidirectional electromagnets to coordinate orientation and magnitude of the magnetic field of the omnidirectional electromagnets to control at least one of a position and an orientation of an object, or to control at least one of a force and a torque applied to an object.

12. A method of manipulating the object of claim 9, comprising:

a. associating the object with the magnetic field of the omnidirectional electromagnets; and b. adjusting an orientation and magnitude of the magnetic field in order to move the object.

13. The method of claim 12, wherein the device is at least one of a capsule endoscope device, a magnetic catheter device, a cochlear implant, a device within an eye, a device within a urinary or reproductive system, a device within the brain or spine, and a device for medical procedures on a developing fetus.

14. The method of claim 12, wherein the device is at least one of a microscale device under the guidance of an optical microscope, a device in outer-space, and a device within a pipe or pipe-like structure.

15. The omnidirectional electromagnet of claim 1, wherein the diameter of the ferromagnetic core is between 55% and 65% of the maximum outer length of the outermost solenoid.

16. The omnidirectional electromagnet of claim 1, wherein the wherein the variance in dipole moment (m) of each solenoid is zero when current density (J) of each solenoid is equal (i.e. $m_x=m_y=m_z$ when $J_x=J_y=J_z$).

17. The omnidirectional electromagnet of claim 1, wherein each of the three orthogonal solenoids have square-cross-section geometries which minimize a quadrupole term in a multipole expansion for the magnetic field produced by the solenoids, where the quadrupole term is proportional to:

$$(15W^2-15L^2+40T^2+30TW)(4T^2+6TW+3W^2)-16T^4$$

where W is inner width, L is length, and T is thickness.

18. The omnidirectional electromagnet of claim 17, wherein the quadrupole term is equal to zero.

* * * * *